United States Patent [19]

McGinnis et al.

[11] Patent Number: 4,774,643

[45] Date of Patent: Sep. 27, 1988

[54] ILLUMINATOR FOR RADIATION DOSIMETER AND METHOD OF MANUFACTURE

[75] Inventors: M. Douglas McGinnis, Glenolden; Hugh J. Diamond, Kennett Square, both of Pa.

[73] Assignee: Diagin, Inc., Kennett Square, Pa.

[21] Appl. No.: 931,376

[22] Filed: Nov. 17, 1986

[51] Int. Cl.[4] ..... F21L 7/00

[52] U.S. Cl. ..... 362/189; 362/800

[58] Field of Search ..... 362/189, 202, 157, 800, 362/201

[56] References Cited

U.S. PATENT DOCUMENTS

| | | | |
|---|---|---|---|
| 1,559,557 | 11/1925 | Zeng . | |
| 2,879,381 | 3/1959 | Coffey | 362/189 |
| 3,256,428 | 6/1966 | Schwartz | 362/196 |
| 3,327,107 | 6/1967 | Gey | 362/189 |
| 3,359,411 | 12/1967 | Schwartz | 362/189 |
| 3,382,408 | 5/1968 | Atkins . | |
| 3,669,095 | 6/1972 | Kobayashi et al. | 128/2.1 R |
| 3,798,437 | 3/1974 | Sarbacher . | |
| 3,903,870 | 9/1975 | Berndt . | |
| 4,122,510 | 10/1978 | Halliday | 362/189 |
| 4,210,953 | 7/1980 | Stone | 362/189 |
| 4,281,250 | 7/1981 | Kronenberg et al. | 250/374 |
| 4,348,715 | 9/1982 | Christensen et al. | 362/202 |
| 4,399,495 | 8/1983 | Leopoldi et al. | 362/189 |
| 4,408,261 | 10/1983 | Polakoff | 362/104 |
| 4,475,903 | 10/1984 | Steenhuisen et al. | 604/111 |
| 4,524,409 | 6/1985 | Yakubek | 362/189 |
| 4,528,621 | 7/1985 | Hoyt | 362/189 |
| 4,577,943 | 3/1986 | Salia-Munoz . | |
| 4,628,418 | 12/1986 | Chabria | 362/189 |

FOREIGN PATENT DOCUMENTS

| | | | |
|---|---|---|---|
| WO85/05432 | 12/1985 | World Int. Prop. O. | 362/202 |

*Primary Examiner*—Charles J. Myhre
*Assistant Examiner*—David A. Okonsky
*Attorney, Agent, or Firm*—Gerry J. Elman

[57] ABSTRACT

The disclosed device provides illumination for a radiation dosimeter or other tubular instrument which is held directly in front of the eye for viewing. It can also be used as a compact flashlight for inconspicuous use such as for reading a map in a car or a program in a theater, and it can be carried by medical personnel to illuminate the eye of a patient. The illuminator comprises a light-emitting diode (LED) protruding through an annular spacer. The leads from the LED are bent around a battery comprising one or more button cells. The inner assembly comprising the LED, spacer and battery is held together by a plastic sleeve of shrink-wrap material, such as polyolefin. The inner assembly is enclosed in a thimble-shaped flexible plastic casing, which is adapted to slide onto the end of a dosimeter for permanent mounting. When the user squeezes the casing, the leads are brought into contact with the batteries, thereby completing the circuit, lighting the LED, and illuminating the dosimeter. The illuminator is fabricated by assembling the parts within a heat-shrinkable plastic sleeve, heating the sleeve to shrink it around the parts to secure them together, and then inserting the shrink-wrapped assembly within the casing.

10 Claims, 2 Drawing Sheets

ILLUMINATOR FOR RADIATION DOSIMETER AND METHOD OF MANUFACTURE

BACKGROUND OF THE INVENTION

This invention relates generally to illuminators and more particularly to a device for illuminating radiation dosimeters in low-light conditions or as a flashlight for inconspicuous use or for use by medical personnel to illuminate the eye of a patient.

Workers in nuclear facilities carry dosimeters to monitor the amount of radiation to which they are exposed. One such device is the Direct Reading Dosimeter available from Dosimeter Corporation of America, 11286 Grooms Road, Cincinnati, Ohio 45242. Such a dosimeter is a tubular device which is read by holding one end directly in front of the eye and pointing the other end toward a light source.

Nuclear workers often spend extended periods in areas with lighting which is insufficient or inconvenient for reading the dosimeter, thus running the risk of being exposed to excessive radiation before taking the next reading. In this situation the dosimeter has heretofore sometimes been illuminated by a penciltype flashlight attached to the end of the dosimeter, the light being activated by pushing a button in a direction towards the eye. The user thus risked injury to the eye. An additional problem was that the combined length of the dosimeter and flashlight made it unwieldy and inconvenient to carry in a pocket.

Playgoers desiring to read program notes and automobile passengers desiring to read a map need a compact, lightweight illuminator which minimizes the spillover of illumination visible to the adjacent playgoer or driver.

Even devices made for ophthalmologists to look into the eye have switches which require pressure in the direction of the eye for activating the illumination. U.S. Pat. Nos. 3,903,870 to Berndt and 4,577,943 are typical examples of prior art devices used to illuminate the eye.

SUMMARY OF THE INVENTION

The present invention provides a new device for illuminating instruments which are held close to the eye. Generally referred to herein as a dosimeter illuminator, the invention is meant to include a light source for use with any instrument which is viewed by holding it directly in front of the eye, for example a kaleidoscope, while looking towards a source of light. The device may also be used to illuminate playbills and maps with minimal spillover of light to distract the adjacent person, and the use of colored rather than white light minimizes distraction as well. It may also be used by medical personnel to examine the condition of the eye of a patient, especially the pupil of an emergency victim.

It is an object of the present invention to provide an illuminating device for dosimeters which fits conveniently onto the end of a conventional dosimeter while adding minimal bulk and weight to the assembly.

It is also an object of the invention to provide a dosimeter illuminator which is activated by applying finger pressure in a direction perpendicular to its axis, thereby eliminating the risk of eye injury to the user inherent in prior art devices which require activation pressure in the axial direction towards the user's eye.

It is yet another object of the invention to provide an illuminator capable of supplying light of a desired color.

It is another object of the invention to provide a dosimeter illuminator which can be inserted onto the end of a radiation dosimeter, left in position for an extended period of time, and then readily decoupled for dosimeter re-zeroing, illuminator disposal when the electrical source therein is drained, etc.

It is another object of the invention to provide a dosimeter illuminator capable of cushioning a dosimeter from shocks when dropped on its end and thereby minimizing downtime.

It is a further object of the present invention to provide a process for assembling an illuminator that is light in weight and comprises a minimal number of elements, each of which is readily available commercially and does not have to be specially manufactured.

It is yet a further object of the present invention to provide a process for assembling an illuminator, by creating a shrink-wrapped subassembly that is easily inserted into a thimble-shaped flexible casing.

The accomplishment of these and other objects will be apparent from the accompanying drawings and following detailed description.

BRIEF DESCRIPTION OF THE DRAWINGS

FIGS. 5 through 12 show the method of manufacturing the illuminator of the present invention, wherein:

FIG. 5 shows a light-emitting diode for use in the illuminator, and

FIG. 6 shows the light-emitting diode of FIG. 5 after its leads are bent for use in the illuminator, and FIG. 7 shows the light-emitting diode of FIG. 6 after an insulating tube has been inserted onto one of its leads, and FIG. 8 shows two button batteries and a section of shrinkwrap tubing for use in the illuminator, and FIG. 9 shows the items of FIG. 8 with the button batteries placed within the shrink-wrap tubing, and FIG. 10 shows the items of both FIGS. 7 and 9, wherein the light-emitting diode has been placed in position within the shrink-wrap tubing with its leads disposed relative to the terminals of the button batteries, and FIG. 11 shows the items of FIG. 10, to which has been added an annular spacer, thereby forming the shrink-wrap assembly 65, and FIG. 12 shows the shrink-wrap assembly 65 after the tubing has been heated to provide a snug fit around the other elements and also shows in phantom the casing 20 in position for receiving the shrink-wrap assembly 65.

DETAILED DESCRIPTION

Figure 1:
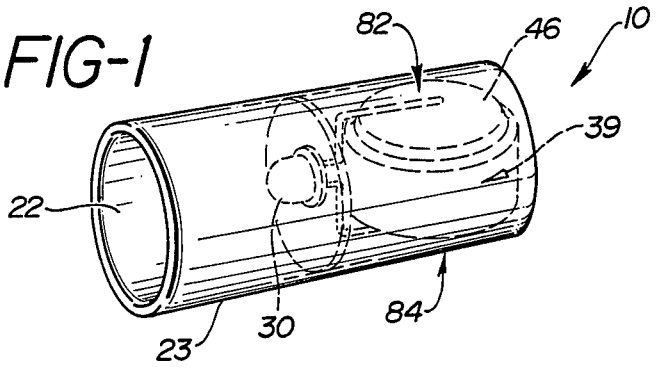
FIG. 1 is a perspective side view of an embodiment of the invention in which a single cell supplies electricity.

The illuminator of the present invention 10 is made up of a light-emitting diode (LED) 30 or other light source with a pair of electrically conducting leads 31, 32 extending therefrom, which are arranged to come in direct contact with a battery 39 of one or more dry cells 41, 42. A shrinkable plastic sleeve 60 holds the aforementioned parts in their proper orientation to an annular spacer 50, and a flexible casing 20 surrounds the shrink-wrapped assembly 65.

In a preferred embodiment two button cells 41, 42 in series comprising a battery 39 are placed end-to-end with oppositely charged terminals 43, 44 in contact with each other. The wire leads 31, 32 of the LED are bent so that one of them (lead 31) is in proximity with the negative terminal 42 of one cell 40 and the other (lead 32) is in proximity with the positive terminal 45 of the other cell 41. There is some spring tension in the leads 31, 32 which keeps them from contacting the terminals 42, 45 in the absence of external pressure.

Figure 2:
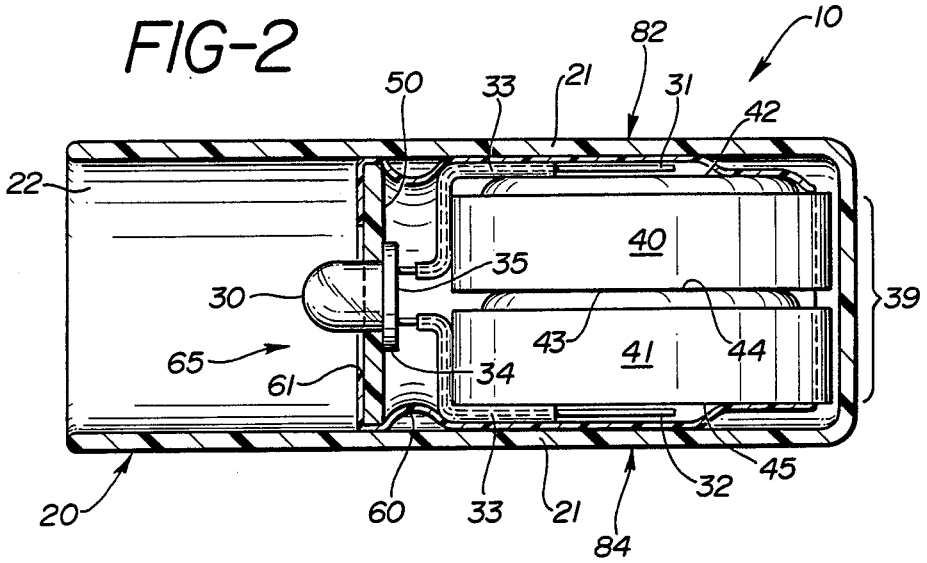
FIG. 2 is a side view of an embodiment of the invention in which two button cells supply electricity, with the casing, sleeve and spacer shown in axial cross-section.

Preferably at least one of the leads 31 is covered with tubular insulation 33 (or "macaroni") along a portion proximal to the base 35 of LED 30 where contact with the terminal 43 is to be avoided to prevent short circuiting when the lead 31 is pressed into contact with terminal 42. The tubular insulation 33 also helps maintain the lead 31 from contacting terminal 42 in the absence of external pressure. As shown in FIG. 2, tubular insulation 33 may optionally be used on the other lead 32 as well.

Figure 13:
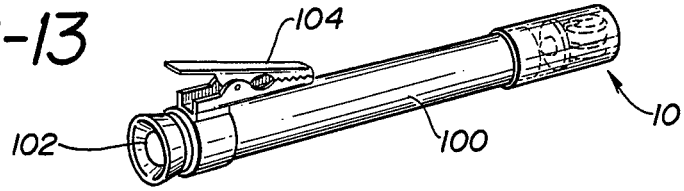
FIG. 13 illustrates an application of the illuminator 10, which is matingly attached to the end of a radiation dosimeter.

The LED 30 has a flange 34 around its base 35 from which the leads 31, 32 project. An annular spacer 50 of insulating material, e.g. a plastic faucet washer, surmounts the LED 30 abutting against the flange 34 on the side opposite from the base 35. A sleeve 60 of shrink-wrap plastic surrounds the assembly 65 so that all the parts are retained in their proper relative orientation. The LED 30 is not covered by the sleeve 60. A thimble-shaped casing 20 of flexible plastic encloses the assembled illuminator such that the LED 30 and annular spacer 50 are visible through the open end of the casing 22. The casing extends beyond the spacer 50 for a length sufficient to accommodate the end of a dosimeter 100. In use, this extended portion 23 of the casing 20 surrounds the end of the dosimeter 100 to be illuminated. As shown in FIG. 13, such a dosimeter 100 may conventionally have an eyepiece 102 at the opposite end from the illuminator 10, and a pocket clip 104.

The illuminator 10 is activated by squeezing the flexible casing 20, causing the leads 31, 32 to come into contact with their respective adjacent battery terminals 42, 45. The casing is desirably marked at points 82 and 84, which indicate the proper place to apply compression. The leads 31, 32 have spring tension which causes them to resume their parallel configuration when any external force is released, thereby opening the circuit.

Figure 3:
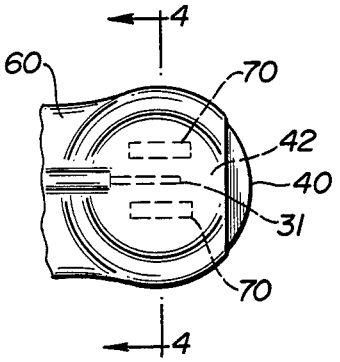
FIG. 3 is a top view of the upper button cell of an alternative embodiment of the invention, in which two button cells supply electricity and resilient strips are affixed to a terminal of the top button cell.
Figure 4:
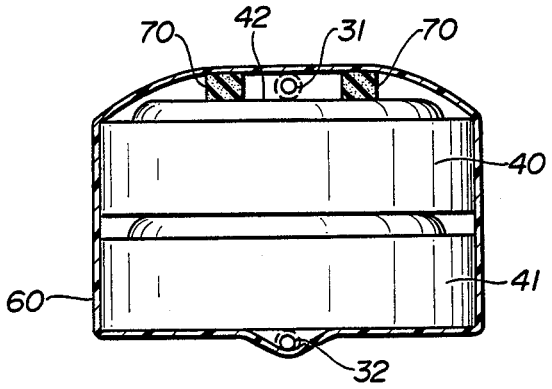
FIG. 4 is a cross-sectional end view taken along line 4—4 of FIG. 3.

The preferred embodiments shown in FIG. 2 and in FIGS. 3 and 4 use two 1.4-volt mercuric oxide button cells 40, 41, such as a Duracell MP675H cell, which is rated 25 mA hr. Alternatively, a battery comprising one or a different number of dry cells, e.g. silver oxide or lithium cells, could be used. FIG. 1 shows an alternative embodiment of the present invention wherein the battery 39 is a single lithium cell 46.

The light source is preferably a light-emitting diode such as is available from Stanley Optoelectronics as ER-300 or ESBR5501. The light source should have a rated output of at least about 150 millicandles and preferably 300 millicandles. We have found that red is the most desirable color, although orange, green or yellow are also preferred. Indeed, for specialized use, such as for the medical use of illuminating the pupil of an accident victim, a different color (here, blue) may be preferable, as blue light has less tendency to induce a seizure. The wire leads extending therefrom are 0.5 in. long. It is important to be aware of the polarity of the LED and place the positive lead in contact with the positive terminal of the battery 39; otherwise the LED will not light up. Alternatively one could use an incandescent light or other light-emitting source, provided of course that the voltage of the source of electricity is appropriate to power the light-emitting source.

The illuminator may optionally be provided with one or more strips 70 of resilient compressible material, such as adhesive foam, on a battery terminal 42 adjacent to a lead 31. Strips 70 assist in preventing contact between the lead wire 31 and the terminal 42 when external pressure is absent.

As shown more particularly in FIG. 1, the dosimeter illuminator generally indicated at 10 includes an opaque black flexible casing 20 enclosing a light-emitting diode (LED) 30. Alternatively, but less preferably, an incandescent light source (not shown) having a pair of conducting leads could be substituted. The casing 20 is made of a resilient plastic material such as vinyl plastic, and the illuminator is adapted to be activated by squeezing on the casing 20 at squeeze points 82 and 84. Desirably, indicia are printed on the casing, as by stenciling or offset, to mark squeeze points 82 and 84. A readily available part that can be used as casing 20 is sold by MOCAP, St. Louis, Mo., as a closure for protecting valves and the threaded areas of pipes. Desirably the casing has a length of about 1.25 in. and inside diameter of about 0.5 in.

As shown in FIG. 2, the LED 30 has a first lead 31 and a second lead 32 projecting from base 35 and bent so that two cells 40 and 41 are disposed between the straight ends of leads 31 and 32. The positively charged terminal 43 of the upper cell 40 is in contact with the negatively charged terminal 44 of the lower cell 41. The ends of leads 31, 32 are substantially parallel, with the distance between them slightly exceeding the thickness of the battery 39, i.e. the combined thickness of the two cells 40, 41, or, as shown for the embodiment of FIG. 1, the thickness of the single cell 46. In this configuration, in the absence of external finger pressure, there is a space between lead 31 and negative terminal 42 of cell 40 which prevents closure of the electrical circuit comprising the LED 30, leads 31, 32 and battery 39. Optionally there may also be a space between lead 32 and positive terminal 45 of cell 41. Upon squeezing the leads 31, 32 toward each other, the leads 31, 32 are brought into contact with the battery 39, thereby lighting the LED 30.

The leads 31 and 32 are bent so that there is spring tension in leads 31, 32 which forces leads 31, 32 to disengage battery 39 when the compressive force is released. As previously mentioned, tubular insulation 33 preferably encloses portions of leads 31, 32 where the leads 31, 32 are bent to accommodate the battery 39.

The LED 30 has at its base a flange 34 of diameter slightly greater than the body of LED 30. For example where the diameter of such an LED is 0.19 in., it has a flange of 0.23 in. diameter. An annular spacer 50 of insulating material, having a hole of diameter large enough to accommodate the body of LED 30 but small enough to preclude passage of flange 34 is disposed about LED 30 so that LED 30 protrudes forward through the spacer 50, and leads 31, 32 project rearward from the base 35 of the LED 30. The spacer 50 may be a 1/32-in. thick faucet washer of inside diameter 0.20 in. and outside diameter 0.505 in.

A sleeve of heat-shrinkable plastic material 60 substantially encases the spacer 50, leads 31, 32 and the battery 39 consisting of the cells 40, 41. The sleeve 60 has an aperture 61 which is greater in diameter than LED 30 and smaller than the outside diameter of the spacer 50. Tension provided by the sleeve 60 maintains spacer 50 firmly seated against the flange 34 of LED 30, and retains the relative configuration of the cells 40, 41, the leads 31, 32 and the LED 30.

The heat-shrinkable plastic material is desirably of polyolefin film with a thickness less than 1/32 in. A preferable form is ½-in. inside-diameter tubing, designed to recover to ¼-in. diameter upon heating, available from Russell Industries, Oceanside, NY, as HUG-12-MSP. Tubing of from ½ in. to ⅜-in diameter could be employed with the geometries of the illustrated embodiments. With ½-in. tubing, the original length is preferably about 11/16 to ¾ in.

The flexible casing 20 is marked with indicia 21 to designate the area to be squeezed to activate the unit. The assembly 65 comprising the shrink-wrap sleeve 60 and the elements contained within is placed within the casing 20 so that the indicia 21 are positioned over leads 31, 32.

FIGS. 3 and 4 show an embodiment of the invention wherein optional strips 70 of a resilient adhesive material of thickness greater than that of leads 31, 32 are interposed between battery terminal 42 and the shrink-wrap sleeve 60. Strips 70 are located on the surface of terminal 42 of cell 40 parallel to and on opposite sides of lead 31. The strips 70 provide an optional means, in addition to the use of tubular insulation 33, of preventing the sleeve 60 from causing lead 31 to come into continous contact with terminal 42 of cell 40.

Figure 5:
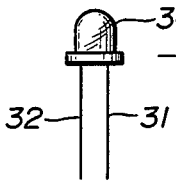
Figure 6:
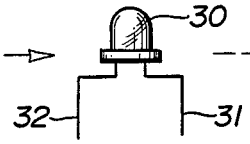
Figure 7:
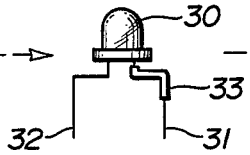

ASSEMBLY—Because of the use of shrink-wrap tubing, the illuminator of the present invention is exceptionally easy to assemble from a minimum of parts and without requiring any soldering, machining or screwing. (Alternatively, lead 32 could optionally be soldered to terminal 45 without departing from the spirit of the invention.) As shown in FIGS. 5 to 6, the leads 31, 32 extending from LED 30 are bent so that their ends are substantially parallel at a distance of approximately 7/16 in. As shown in FIG. 7, one of the leads, lead 31, is threaded through tubular insulation 33 to cover the portion of the lead proximal to LED 30, which portion remains in continuous contact with the battery 39. Optionally, lead 32 may be similarly provided with tubular insulation, as shown in FIG. 2.

Figure 8:
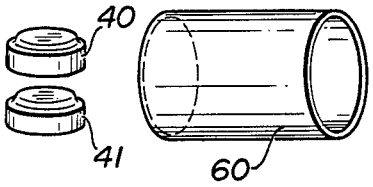
Figure 9:
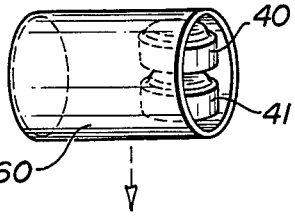
Figure 10:
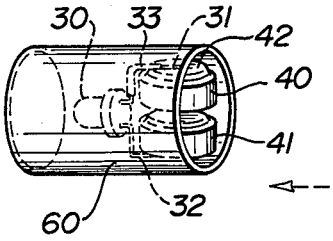

As shown in FIG. 8, a battery 39 of one or more cells 40, 41 in series is provided. Strips 70 of resiliently compressible adhesive material may optionally be placed on negative terminal 42 of cell 40 as shown in FIGS. 3 and 4. As shown in FIG. 9, the battery 39 is placed within a section of heat-shrinkable plastic tubing 60 of approximately ¾ in. length. As shown in FIG. 10, the LED 30 is then inserted into the tubing 60 so that one lead 31 is disposed above negative terminal 42 of battery 39, and the other lead 32 is disposed below positive terminal 45 of battery 41. The battery 39 is oriented so that when the leads 31 and 32 contact the cells 40, 41, charge flows in the proper direction to illuminate the LED 30. Lead 31 is disposed between strips 70 if such strips are provided, as shown in FIGS. 3 and 4.

Figure 11:
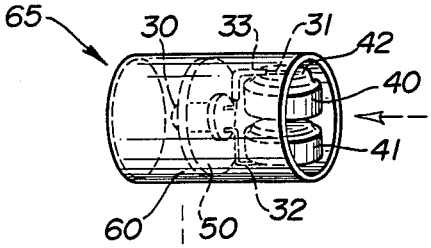

As shown in FIG. 11, a spacer 50 having a hole larger than the body of LED 30 but smaller than the flange 34 of LED 30 is inserted into the tubing 60 so that it abuts flange 34 and accommodates the body of LED 30.

The assembly 65 thereby formed is placed on end (LED 30 up) in a 250-deg. F oven to cause the tubing to shrink around the LED 30 and spacer 50. This generally takes about 20–30 sec. Preferably the assembly is then turned on its side and immediately replaced in the oven for another 20–30 sec. until the sleeve 60 contracts about the cells 40, 41 with sufficient tension to retain the configuration of the assembly 65. If, however, the assembly is allowed to cool after the initial step, the second heating step may require about 45 sec. We have found that this two-step heating process not only prevents the battery from becoming too hot and adversely affecting service life, but also that if the first heating step is continued beyond about 30 sec., the top of the sleeve 60 contracts too much and causes the battery 39 to pop out of the bottom of the sleeve 60.

Figure 12:
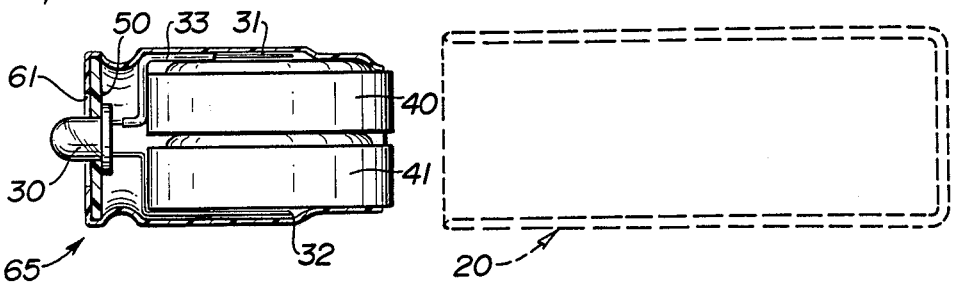

As shown in FIG. 12, the assembly 65, after cooling, is inserted within thimble-shaped casing 20 so that the LED 30 and spacer 50 are visible through the cylindrical aperture 22 of the casing 20.

In use, the end of a dosimeter 100 or other optical device is inserted into the cylindrical aperture 22 of the casing 20 to mate permanently therewith, as shown in FIG. 13, until, after its service life, the electrical power in the battery is spent and the illuminator is thrown away and replaced, or it is desired to re-zero the dosimeter.

Having thus described our invention, what it is desired to secure by Letters Patent and hereby claim is:

1. A battery-operated illuminator comprising:

(a) a battery having a first terminal on one side and a second terminal on a side opposite to the first, (b) a light-emitting element from which a first wire lead and a second wire lead extend, the first lead extending to a position adjacent said first terminal and the second lead extending to a position adjacent said second terminal, at least one of said leads being normally out of electrical contact with the adjacent terminal in the absence of external pressure, (c) an annular spacer having a first side and an opposite side, said spacer being disposed around said light-emitting element such that said light-emitting element extends through the first side of said spacer and said leads extend from the opposite side of said spacer, (d) a sleeve of plastic film substantially enclosing the following elements: said battery, light-emitting element, leads and annular spacer, said film having a shape and strength sufficient to retain the relative configuration of said elements substantially enclosed therein, and (e) a resilient flexible casing substantially housing the sleeve and said elements substantially enclosed therein, an end of said casing forming a generally cylindrical aperture adapted for mating with an optical device to be illuminated and through which said light-emitting element and annular spacer are visible, said leads and battery being disposed such that when pressure is applied to the casing in a direction perpendicular to the axis of said aperture, said leads make electrical contact with their respective said terminals, whereby an electrical circuit is completed and the illuminator is activated.

2. The illuminator of claim 1 wherein the battery comprises a plurality of button cells in electrical contact with each other in series.

3. The illuminator of claim 2, further including strips of a resilient material disposed upon a terminal surface of one of said button cells laterally and parallel to said first lead and on opposite sides of said first lead, whereby the plastic sleeve is prevented from holding said first lead in contact with said terminal of said button cell.

4. The illuminator of claim 2, wherein the light-emitting element is a light-emitting diode.

5. The illuminator of claim 4, wherein the light-emitting diode has a rated output of at least about 150 millicandles.

6. The illuminator of claim 2, wherein the light-emitting element is an incandescent bulb.

7. A method of assembling an illuminator, comprising the steps of:

(a) inserting a battery having a pair of oppositely charged terminals into a heat-shrinkable sleeve, (b) providing a light-emitting element having a pair of wire leads extending therefrom, bending said leads so that their ends are substantially parallel at a distance sufficient to accommodate the terminals of the battery therebetween, and threading tubular insulation on at least a portion of one of the leads, (c) inserting the light-emitting element into said sleeve and juxtaposing said ends of said leads with the terminals of said battery, (d) inserting an annular spacer into the sleeve such that the light-emitting element protrudes at least partially therethrough, and then (e) heating the sleeve at a temperature less than about 300 deg. F, whereby the sleeve shrinks to substantially enclose the elements and maintain them in the configuration formed thereby, (f) inserting the sleeve and its contents into a resilient casing having a cylindrical aperture, in a direction so that the light-emitting element is visible through the aperture and pressure on said casing in a direction perpendicular to the axis of said aperture closes a circuit to activate the light-emitting element.

8. A method of assembling an illuminator, comprising the steps of:

(a) placing a first button cell in juxtaposition with a second button cell so that one terminal of said first button cell contacts the oppositely charged terminal of said second button cell, the distance between the terminals of the first and second button cells which are not in contact being the combined thickness of said button cells, (b) providing a light-emitting element having a body, a flange at the base of said body, and two wire leads, and bending the leads thereof to a substantially parallel configuration with a distance between said leads slightly exceeding the combined thickness of said button cells, (c) placing said button cells between said leads so that each of said leads is disposed in close proximity to said opposite charged terminals of said button cells, (d) placing an annular spacer around said lightemitting element so that said spacer abuts a flange at the base of said light-emitting element and accommodates the body of said light-emitting element, (e) placing an insulating sleeve around a portion of at least one of said leads where said lead is bent to accommodate said button cells, (f) inserting the assembly resulting from steps a through e into a sleeve of heat-shrinkable material sufficient to retain the assembled configuration when heated, (g) placing the assembly resulting from steps a through f in a heat source of sufficient temperature and for a sufficient time to cause the shrinkage of said heat-shrinkable material, (h) inserting the assembly resulting from steps a through g into a thimble-shaped resiliently flexible casing so that the light-emitting element is visible.

9. An assembly comprising:

(a) a battery having positive and negative terminals, (b) a light emitting diode having positive and negative leads, (c) an annular spacer through which a portion of the lightemitting diode extends, and (d) a sleeve of heat-shrunk film substantially surrounding said battery, light-emitting diode and spacer and maintaining them in relationship such that the positive and negative leads of the light-emitting diode juxtapose the positive and negative terminals of the battery without making electrical contact therewith in the absence of external pressure.

10. In combination, the illuminator of claim 1 and a cylindrical radiation dosimeter having an aperture at one end, through which illumination is required, wherein the illuminator is matingly attached to the end of the dosimeter requiring illumination through said aperture.

* * * * *